US006089658A

United States Patent [19]

Law

[11] Patent Number: 6,089,658

[45] Date of Patent: Jul. 18, 2000

[54] WHEELCHAIR FOOTPLATE COVER AND STABILIZER

[76] Inventor: Robert Law, P.O. Box 252, Delta, Utah 84624

[21] Appl. No.: 09/205,987

[22] Filed: Dec. 4, 1998

[51] Int. Cl.[7] ..... A47C 31/00

[52] U.S. Cl. ..... 297/219.1; 297/423.4

[58] Field of Search ..... 297/219.1, 423.4, 297/183.1, 423.39, 463.2, 463.1, DIG. 4; 280/291, 304.1, 304.4

[56] References Cited

U.S. PATENT DOCUMENTS

| | | | |
|---|---|---|---|
| D. 282,832 | 3/1986 | Kain | D12/133 |
| D. 305,521 | 1/1990 | Wiatrak et al. | D12/133 |
| D. 315,539 | 3/1991 | Okamoto | D12/133 |
| 2,746,527 | 5/1956 | Liebich | 297/423.4 |
| 2,986,437 | 5/1961 | Davis | 297/423.4 X |
| 3,113,326 | 12/1963 | Hyde et al. | 297/291.1 X |
| 3,672,722 | 6/1972 | Murcott | 297/423.4 X |
| 3,848,922 | 11/1974 | Blanford | 297/219.1 |
| 5,352,013 | 10/1994 | Rusyniak | 297/423.4 X |
| 5,378,041 | 1/1995 | Lee | 297/423.4 X |
| 5,449,222 | 9/1995 | Titchener et al. | 297/423.4 |
| 5,833,318 | 11/1998 | Knight | 297/423.4 |

FOREIGN PATENT DOCUMENTS

| | | | |
|---|---|---|---|
| 2194731 | 3/1988 | United Kingdom | 297/423.4 |

OTHER PUBLICATIONS

Brochure—Quickie Rigid Chair Series No Date.

*Primary Examiner*—Milton Nelson, Jr.
*Attorney, Agent, or Firm*—Madson & Metcalf

[57] ABSTRACT

A cover and stabilizer made of a thin ridged material that slips over wheelchair footplates. The cover having a base (16) of adequate size to cover the surface of the footplates. A front retainer (18) fits against, and the upward retainer (20) slips under the leading edge of the footplates. The rear retainer (14) fits behind the rear edge of the footplates. The patient heel stop (12) is perpendicular to base (16) with a safety edge (10) running along the top edge. If a patient does not require the heel stop (12) then a fill length rear retainer (14) is added with a handle (22).

20 Claims, 2 Drawing Sheets

WHEELCHAIR FOOTPLATE COVER AND STABILIZER

BACKGROUND

1. The Field of the Invention

This invention relates to wheelchairs and, more particularly, to novel systems and methods for supporting a user on foldable footplates of a collapsible wheelchair.

2. The Background Art

For many years wheelchairs were one solid unit, bulky, hard to transport, and very user unfriendly. However, these wheelchairs did provide a means for people with limited mobility to move around. These wheelchairs had a one piece solid, non-removable footplate that made it difficult for many patients to get out of the wheelchair. This particular difficulty was solved when the two fold-up footplates were developed. These fold-up footplates have at least two advantages: 1) the footplates fold up allowing a patient to easily get out of the wheelchair, and 2) they enabled manufacturers to develop a collapsible easy to transport wheelchair.

The fold-up footplates come with some disadvantages also: 1) there is a gap between the two footplates varying in size depending upon the wheelchair manufacture and design, 2) many of these footplates are unstable and bend down when down pressure is applied, and 3) many of the footplates have no provision for keeping the patient's feet from slipping off to the rear.

The Wheelchair Footboard, Patent Number Des. 305,521 issued Jan. 16, 1990, is a wheelchair footplate. This particular footplate design is common. These footplates, fold up to allow a patient to place feet upon the floor, or fold down for a patient to rest the feet on. When these footplates are in the down position there is a gap between them, and when the patient applies down pressure, the footplates bend allowing the patients feet to slip down into the gap causing pain and discomfort. This footplate design also has no provision for keeping the patient's feet from slipping off to the rear.

The Footplate Assembly For a Wheelchair, Patent Number Des. 315,539, issued Mar. 19, 1991, addresses the addition of a strap attached to the support tubing and attached to a peg at the back corner of the footplate. This design does not allow a patient to put the feet close together. Many patients would prefer, on many occasions, to have the feet together. If a patient, with this design, puts the feet as close together as possible and applies down pressure, the footplates will bend down causing the pegs holding the straps to the footplates, to dig into the patient's adjacent feet.

The Stroller Foot Rest, patent Number Des. 282,832, issued Mar. 4, 1986, is a one piece footrest for a stroller. This type of footrest is incorporated into some wheelchairs, however this design does not fold up out of the way, for a patient to easily place the feet on the floor. This type of footrest is designed to be permanent part of the stroller as well as a permanent part of a wheelchair.

The subject of this patent application is designed, among other things, to cover, bridge the gap, stabilize, and help keep a patient's feet from slipping off to the rear, on the wheelchair footplate.

BRIEF SUMMARY AND OBJECTS OF THE INVENTION

In view of the foregoing, it is a primary object of the present invention to provide: stability to existing wheelchair footplates.

It is an object of the invention to provide a surface area across both footplates for a patient to comfortably position the feet.

It is an object of the invention to provide a heel stop so a patient's feet do not slip off to the rear.

It is an object of the invention to provide a means to bridge the gap between the two footplates.

It is an object of the invention to provide a simple means to slip the device on and off.

It is an object of the invention to provide a completely portable easy to use device.

Further objects and advantages of the invention will become apparent from a consideration of the drawings and ensuing description.

Consistent with the foregoing objects, and in accordance with the invention as embodied and broadly described herein, an apparatus and method are disclosed, in suitable detail to enable one of ordinary skill in the art to make and use the invention. In certain embodiments an apparatus and method in accordance with the present invention may include multiple retainers for restraining feet of a user and for retaining a plate or deck across the double footrests of a collapsible wheelchair. The apparatus in accordance with the invention is an easy-to-use accessory device for a wheelchair that covers, stabilizes, and bridges a gap on the two wheelchair footplates.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 4, is not intended to limit the scope of the invention. The scope of the invention is as broad as claimed herein. The illustrations are merely representative of certain, presently preferred embodiments of the invention. Those presently preferred embodiments of the invention will be best understood by reference to the drawings, wherein like parts are designated by like numerals throughout.

Those of ordinary skill in the art will, of course, appreciate that various modifications to the details of the Figures may easily be made without departing from the essential characteristics of the invention. Thus, the following description of the Figures is intended only as an example, and simply illustrates one presently preferred embodiment that is consistent with the invention as claimed.

The apparatus, as shown in FIGS. 1–4, could be manufactured from any relatively thin rigid strong material (sheet metal, fiberglass, plastic, etc.). The preferred material is 20 gauge galvanized sheet metal.

Figure 1:
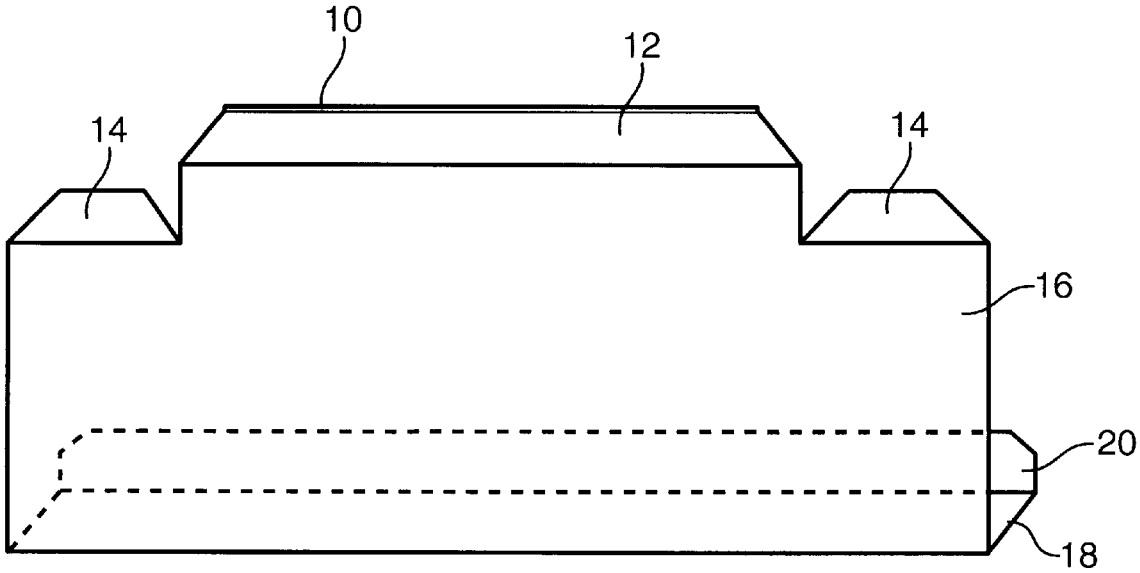
FIG. 1 is a top plan view of one embodiment of an apparatus in accordance with the invention.
Figure 2:
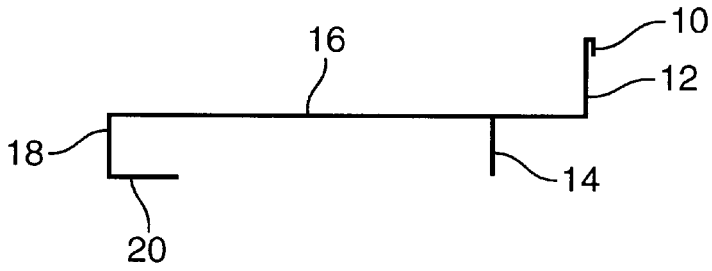
FIG. 2 is a side elevation view of the apparatus of FIG. 1.

FIGS. 1–2 show an overall view of the apparatus. A safety edge 10 is a small amount of the metal bent around, down, and back against itself, to eliminate the sharp metal edge. A heel stop 12 is bent up 90 degrees from base 16, at a location dependent upon the patient's foot size, with the ends cut at a 45 degree angle or rounded. The rear retainers 14 are tabs bent down 90 degrees from base 16, in a location at the rear of the wheelchair footplates and extending down a distance equal to the thickness of the wheelchair footplates, with the inner and outer ends cut on a 45 degree angle or rounded.

The base 16 is where the patient's feet rest, is long enough to cover the wheelchair footplates, and wide enough to accommodate the patient's feet. The underside of the base 16 overlays the flat surface of the wheelchair footplates. A front retainer 18 is bent down at 90 degrees from base 16 a distance equal to the thickness of the wheelchair footplates, plus enough to allow for the upward retainer 20.

The upward retainer 20 is bent back from the front retainer 18, creating an angle slightly greater than 90 degrees that allows the leading edge of the wheelchair footplates to slip into the formed U shape. The upward retainer 20 has a depth adequate to keep the device from raising off the wheelchair footplates, and has the ends cut at a 45 degree angle or rounded.

Figure 3:
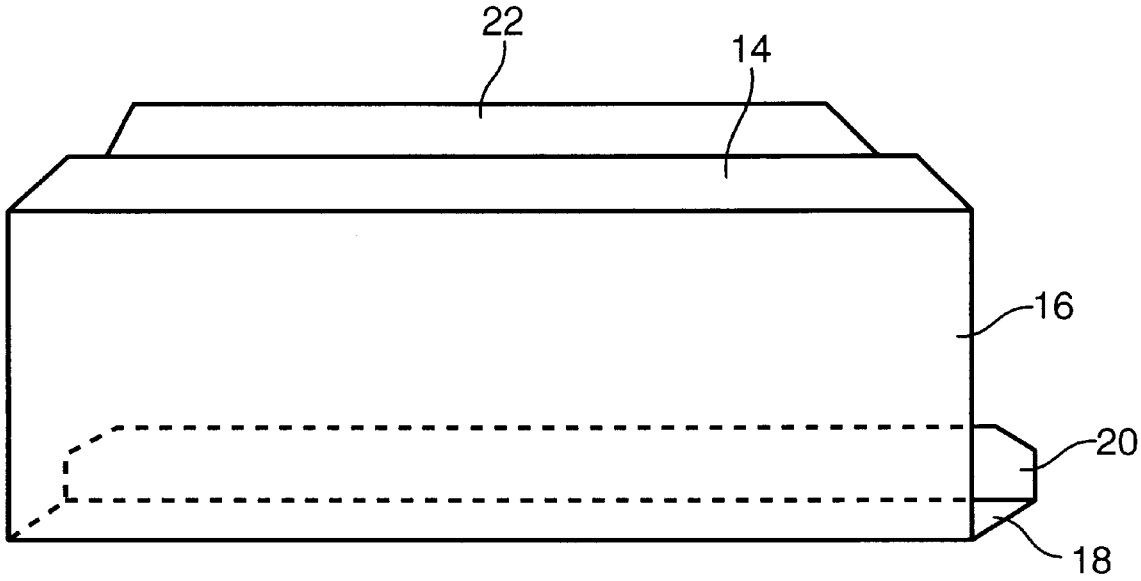
FIG. 3 is a top plan view of an alternative embodiment.
Figure 4:
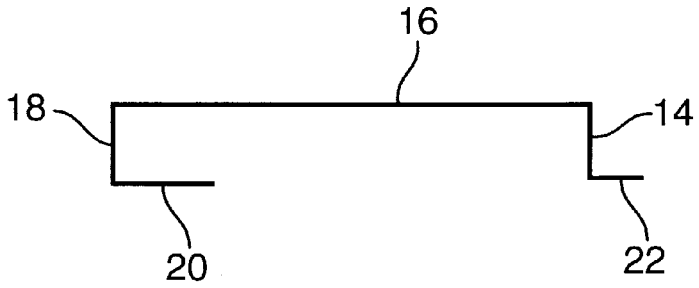
FIG. 4 is a side elevation view of the apparatus of FIG. 3.

FIGS. 3–4 show an overall view of the apparatus, with the rear retainer 14 running the fill length of the invention. The base 16, the front retainer 18, and the upward retainer 20, all remain the same as previously described. The handle 22 is bent back from the rear retainer 14, this allows the apparatus to be easily removed.

FIG. 4 shows the side view of FIG. 3. With an occupant sitting in the wheelchair and with the occupant's feet raised, the wheelchair footplates are placed in the down position. After placing the wheelchair footplates in the down positions, a service provider or the occupant grasps the device in one hand, putting the fingers on the upward retainer 20, the thumb on base 16, and the palm against the front retainer 18. Then a user places the invention upon the wheelchair footplates, with the leading edge of the wheelchair footplates contacting the invention at a point in the center and on the under side of the wheelchair footplates contacting the invention at a point in the center and on the under side of base 16.

The invention is then slid back, allowing the upward retainer 20 to slide under the leading edge of the wheelchair footplates until the front retainer 18 contacts the leading edge of the wheelchair footplates and the rear retainer 14 slips behind at the rear edge of the wheelchair footplates. At this point the device is installed and the occupant's feet are placed upon base 16 with the heels placed back against the patient heel stop.

The weight of the occupant's feet keeps the invention, and base 16, flat upon the surface of the two wheelchair footplates. If the occupant slides the feet forward the rear retainer 14 stops the device from slipping forward, and if the occupant slides the feet back the front retainer 18 stops the device from slipping back. The upward retainer 20 stops the device from raising up and off the wheelchair footplates.

The safety edge 10, along the top length of the patent heel stop 12, is to prevent possible cuts if a patient inadvertently places the feet on top of the patient heel stop 12. The ends of, the patient heel stop 12, the rear retainer 14, and the upward retainer 20, are cut at a 45 degree angle or are rounded off for safety reasons.

The angles created, at the juncture of base 16 and front retainer 18, along with the juncture of base 16 and patient heel stop 12 or rear retainer 14, reinforce the invention and stabilize the wheelchair footplates.

To remove the device, the occupant raises the feet off base 16. The service provider or the occupant grasps the device at the patient heel stop 12, or at the handle 22, and lifts the rear part of the invention high enough for the rear retainer 14 to clear the surface of the wheelchair footplates. The invention is then moved forward until the upward retainer 20 moves past the front edge of the wheelchair footplates. At this point, the apparatus has been removed and can be places aside or used on another wheelchair.

Accordingly, the reader will see that an apparatus in accordance with the invention is a simple easy to use invention designed to cover and stabilize the two footplates on a wheelchair.

The wheelchair footplates have a gap between them, and when a wheelchair occupant applies down pressure, the gap widens and allows the occupants feet to slip into the gap. When this happens, the edges of the footplates dig into the occupant's feet causing pain and discomfort. On a wheelchair with the two footplates design, an occupant becomes very reluctant to reposition the feet or move in any way.

When the apparatus is properly installed, an occupant can reposition the feet to a more comfortable location, with the assurance the feet will not slip into any gap. An occupant can also apply down pressure with the confidence and assurance that the feet will be on a solid stable surface. When an occupant places the heels against the patient heel stop, and realizes the feet are not to slip off to the rear, they can completely relax the feet and legs.

The wheelchair footplates could be completely removed from the support tubing. The apparatus could be lengthened, having the upward retainer going under the support tubes, and the front retainer fitting against the front edge of the support tubes, with a means of having a rear retainer.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus for attachment to a wheelchair of a type having double footrests configures to support feet of a user thereon and having substantially mutually orthogonal longitudinal, lateral, and transverse directions, the apparatus comprising:

a base portion, sized to extend longitudinally and laterally for substantially covering double footrests of a wheelchair;

a registration portion attached to the base portion to align against the footrests, stopping relative longitudinal movement therebetween; and a securement portion connected to the base portion to extend longitudinally below the double footrests for resisting transverse movement with respect thereto.

2. The apparatus of claim 1, wherein the base portion is formed to extend substantially rigidly.

3. An apparatus for attachment to a wheelchair, having double footrests and substantially mutually orthogonal longitudinal, lateral and transverse directions, the apparatus comprising:

a substantially rigid base portion sized to extend longitudinally and laterally for substantially covering double footrests of a wheelchair;

a registration portion attached to the base portion to resist longitudinal movement thereof;

a securement portion connected to the base portion to resist transverse movement thereof; and a heel retainer spaced from the registration portion and extending transversely away from the base portion for retaining a foot of a user on the base portion.

4. The apparatus of claim 3, wherein the registration portion extends transversely away from the base portion.

5. The apparatus of claim 4, wherein the securement portion is rigidly connected to the registration portion to extend substantially longitudinally therefrom.

6. The apparatus of claim 5, further comprising a restraint portion spaced from the registration portion and extending transversely away from the base portion, the restraint portion being adapted to engage a double footrest for restraining the apparatus against longitudinal movement with respect thereto.

7. The apparatus of claim 6, wherein the base portion, registration portion, and restraint portion are formed of a single homogeneous piece of stock.

8. The apparatus of claim 7, wherein the securement portion is formed of the single homogeneous piece of stock.

9. The apparatus of claim 8, wherein the stock comprises sheet metal.

10. The apparatus of claim 8, wherein the stock comprises a polymeric material.

11. A cover adapted to footrests of a wheelchair, having substantially orthogonal directions extending longitudinally, laterally and transversely with respect thereto, the cover comprising:

a base extending longitudinally and laterally to cover a double footrest of a wheelchair, a front retainer extending laterally along a front edge of the base and transversely away therefrom;

an upward retainer extending longitudinally away from the front retainer, being secured to extend laterally therealong, for resisting transverse motion of the cover.

12. The cover of claim 11, wherein the cover comprises a continuous plate forming the base, and having the front retainer extending substantially continuously therefrom to the upward retainer.

13. The cover of claim 12, wherein the cover further comprises the continuous plate formed to extend laterally along a rear edge of the base, and extending transversely away from the base along the rear edge thereof.

14. The cover of claim 11, further comprising a rear retainer connected to the base for resisting longitudinal motion of the base with respect to a wheelchair double footrest.

15. The cover of claim 14, further comprising a heel stop connected to the base to extend transversely thereabove for resisting longitudinal motion of a foot of a rider.

16. The cover of claim 14, wherein the rear retainer extends transversely away from the base.

17. The cover of claim 16, wherein the rear retainer is spaced from the front retainer to extend substantially parallel thereto in a transverse direction away from the base.

18. The cover of claim 17, wherein the upward retainer is spaced from the base to extend laterally and longitudinally in a direction substantially parallel thereto.

19. The cover of claim 18, further comprising a handle.

20. The cover of claim 18, further comprising a heel stop connected to the base for resisting longitudinal motion of a foot of a rider thereon.

* * * * *